United States Patent [19]

Hamada et al.

[11] Patent Number: 4,971,373

[45] Date of Patent: Nov. 20, 1990

[54] NOISE SUPPRESSING DEVICE IN LOCK DEVICE FOR VEHICLE

[75] Inventors: Yoshikazu Hamada; Tetsuzo Igata; Atsuo Suzuki, all of Utsunomiya; Makoto Sakamoto, Nirasaki, all of Japan

[73] Assignee: Mitsui Kinzoku Kogyo Kabushiki Kaisha, Tokyo, Japan

[21] Appl. No.: 412,308

[22] Filed: Sep. 26, 1989

[30] Foreign Application Priority Data

Sep. 26, 1988 [JP] Japan ..... 63-240261
Sep. 26, 1988 [JP] Japan ..... 63-240262
Sep. 26, 1988 [JP] Japan ..... 63-240263

[51] Int. Cl.[5] ..... E05C 3/06

[52] U.S. Cl. ..... 292/216; 292/DIG. 56; 292/DIG. 61; 292/341.12

[58] Field of Search ..... 292/216, DIG. 56, 341.12, 292/341.13, DIG. 61

[56] References Cited

U.S. PATENT DOCUMENTS 2,688,509 9/1954 Schonitzer ..... 292/DIG. 56 X
3,844,593 10/1974 Slattery ..... 292/216 X
4,298,223 11/1981 Raffelsiefer et al. ..... 292/216
4,783,103 11/1988 Schlegel ..... 292/216

*Primary Examiner*—Richard E. Moore
*Attorney, Agent, or Firm*—Browdy and Neimark

[57] ABSTRACT

A noise suppressing device in a lock device for a vehicle, including a body to be fixed to a door of the vehicle; a latch rotatably supported in the body and adapted to be rotated by engagement with a striker fixed to a vehicle body; a ratchet rotatably supported in the body and adapted to engage a full-latch stepped portion of the latch and thereby prevent reverse rotation of the latch; first and second spring members for biasing the ratchet to engage the same with the latch; and an open lever for releasing engagement of the ratchet with the full-latch stepped portion; wherein the first spring member normally biases the ratchet to engage the same with the latch, and the second spring member does not bias the ratchet under a full-latch condition where the ratchet is engaged with the full-latch stepped portion of the latch, while when the ratchet is rotated in a releasing direction, the second spring member biases the ratchet.

6 Claims, 9 Drawing Sheets

NOISE SUPPRESSING DEVICE IN LOCK DEVICE FOR VEHICLE

FIELD OF THE INVENTION

The present invention relates to a lock device for a vehicle, and more particularly to a device for suppressing a noise to be generated upon releasing of a ratchet from a latch.

PRIOR ART

In a conventional lock device for a vehicle having a latch adapted to engage a striker fixed to a vehicle body and a ratchet for preventing reverse rotation of the latch, there is a problem that when the ratchet is released from the latch, the ratchet is kicked by the latch to generate a considerably large impact noise.

Such a large impact noise can be reduced simply by increasing an elastic modulus of a spring for biasing the ratchet against the latch. However, an increase in the elastic modulus causes a large operational load to be required for rotation of the ratchet, resulting in bad operability.

To solve this problem, there has been proposed in Japanese Patent Laid-open Publication No. 62-72876 a lock device employing a rubber damper in addition to the spring without increasing the elastic modulus of the spring. Referring to FIG. 1 which shows the prior art lock device, a lock body A to be fixed to a vehicle door is provided with a latch C adapted to be rotated by engagement with a striker B fixed to a vehicle body, and a ratchet E adapted to engage a full-latch stepped portion D of the latch C and thereby prevent reverse rotation of the latch C. A spring F is provided in the vicinity of the ratchet E to elastically urge the ratchet E against the latch C and thereby maintain a full-latch condition. Furthermore, a rubber damper G is also provided in the vicinity of the ratchet E to elastically suppress movement of the ratchet E from the full-latch stepped portion D in a releasing direction.

PROBLEM IN THE PRIOR ART

However, the above-mentioned noise suppressing device in the prior art still has a problem that a noise suppression effect is not maintained constant. As the result of investigation, it has been found that such a variation in the noise suppression effect is caused by a seasonal temperature change. That is, an elastic modulus of the rubber damper G is finely varied with the seasonal temperature change to cause the variation in the noise suppression effect.

OBJECT OF THE INVENTION

Accordingly, it is an object of the present invention to provide a noise suppressing device in a lock device for a vehicle which is not affected by such a seasonal temperature change.

DETAILED DESCRIPTION OF THE PREFERRED EMBODIMENTS

Figure 1:
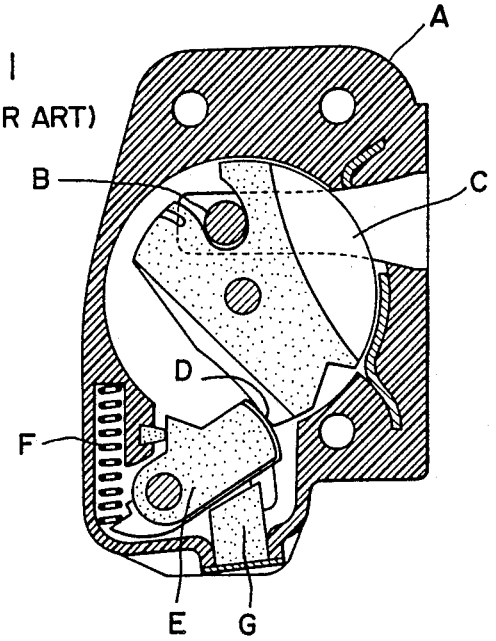
FIG. 1 (PRIOR ART)
FIG. 1 is a vertical sectional view of the lock device in the prior art.

Referring to FIGS. 2 to 9 which show a first preferred embodiment of the present invention, a lock body 1 is formed of a synthetic resin, and it is formed with a recess 4 for accommodating a latch 2 and a ratchet 3 and with a passage 6 for allowing pass of a striker 5 fixed to a vehicle body. The latch 2 is rotatably supported to a shaft 7, and the ratchet 3 is rotatably supported to a shaft 8.

The latch 2 is formed with a groove 9 adapted to engage the striker 5, a half-latch stepped portion 10 and a full-latch stepped portion 11. The ratchet 3 is formed with an engagement surface 13 adapted to engage the half-latch stepped portion 10 and the full-latch stepped portion 11. The full-latch stepped portion 11 is formed with an arcuate corner 14, and the engagement surface 13 is formed with a corner 15.

The lock body 1 is further formed with a recess 31 for accommodating a compression spring 12 which normally biases the ratchet 3 against the latch 2.

Figure 4:
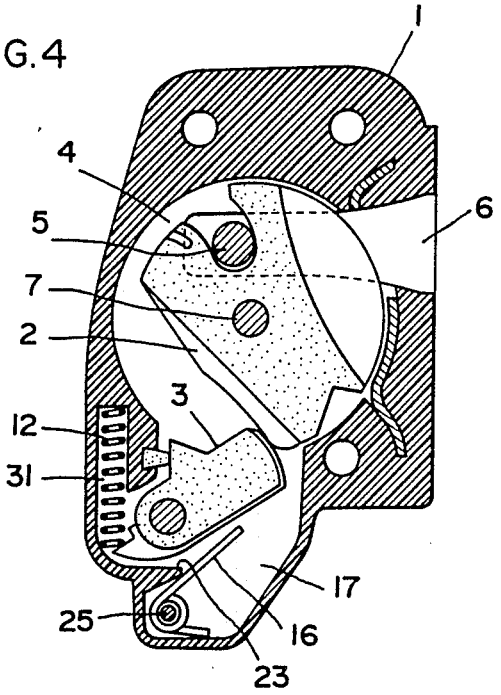
FIG. 4 is a view similar to FIG. 3, showing the door closed condition.
Figure 8:
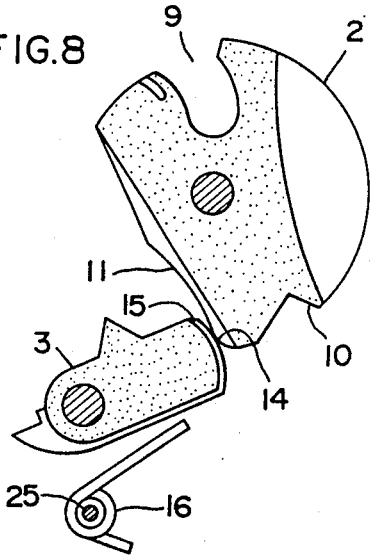
FIG. 8 is an elevational view of the essential part of the lock device under the full-latch condition.
Figure 9:
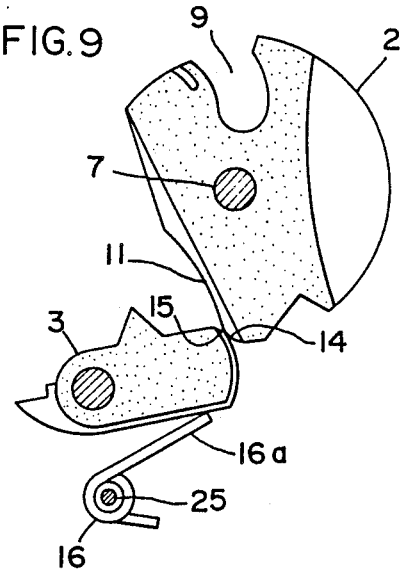
FIG. 9 is a view similar to FIG. 8, showing the condition where the ratchet and the latch face each other at their corners.
Figure 10:
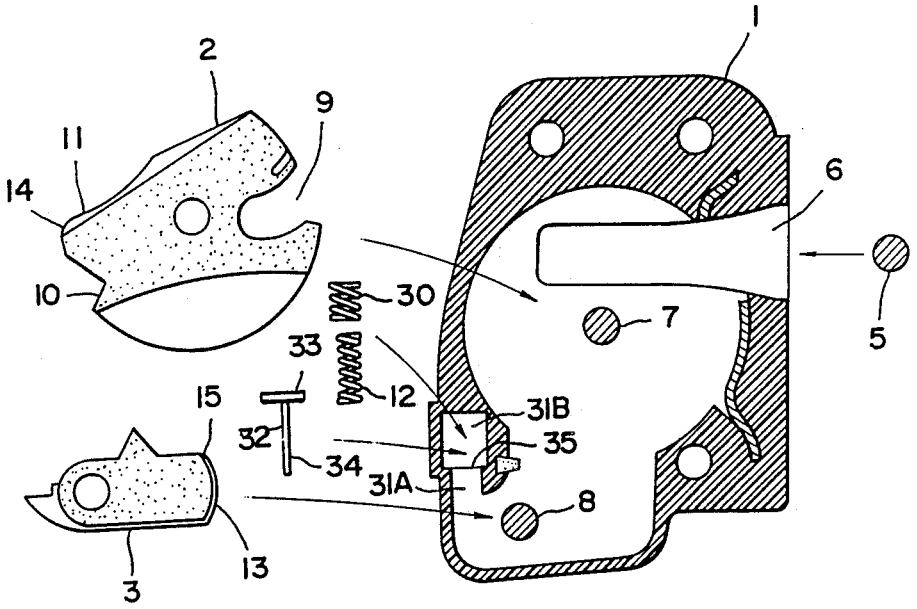
FIG. 10 is an exploded view of the lock device in a second preferred embodiment of the present invention.

The lock body 1 is further formed at its lower portion with a space 17 for accommodating a helical torsion spring 16 mounted on a shaft 25. In a full-latch condition (door closed condition) where the ratchet 3 is engaged with the full-latch stepped portion 11 of the latch 2 as shown in FIGS. 4 and 8, a leg portion 16*a* of the torsion spring 16 is engaged with a stopper 23 projecting into the space 17 so as not to apply a biasing force to the ratchet 3. However, in opening a vehicle door, when the corner 15 of the ratchet 3 comes to a position facing to the arcuate corner 14 of the latch 2 as shown in FIG. 9, the ratchet 3 is elastically engaged with the outer peripheral surface of the latch 2 by the biasing force of the torsion spring 16.

Figure 5:
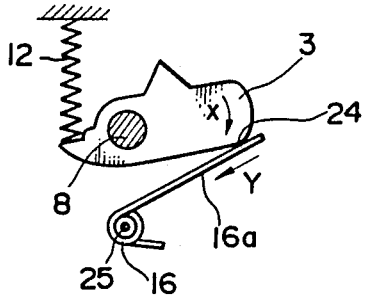
FIGS. 5 and 6 are operational views of a part of the lock device, showing different arrangements of a torsion spring.
Figure 6:
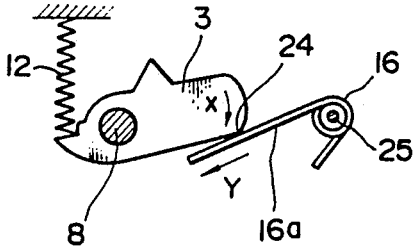

An elastic characteristic of the torsion spring 16 is dependent on a mounting direction of the torsion spring 16 as shown in FIGS. 5 and 6, and the mounting direction shown in FIG. 5 is preferable. That is, in the case of mounting the torsion spring 16 as shown in FIG. 5, when the ratchet 3 is released from the full-latch stepped portion 11 of the latch 2 to be rotated clockwise as shown by an arrow X, a contact point 24 between the torsion spring 16 and the ratchet 3 is moved in a direction as shown by an arrow Y. Therefore, the elastic force of the torsion spring 16 to be applied to the ratchet 3 is gradually increased as the ratchet 3 is rotated. Accordingly, a door opening feeling is improved. In contrast, in the case of mounting the torsion spring 16 as shown in FIG. 6, when the ratchet 3 is rotated clockwise as shown by the arrow X, the contact point 24 between the torsion spring 16 and the ratchet 3 is moved in a direction as shown by an arrow Z. Therefore, the elastic force of the torsion spring 16 to be applied to the ratchet 3 is gradually decreased. Accordingly, the door opening feeling is somewhat deteriorated.

Figure 7:
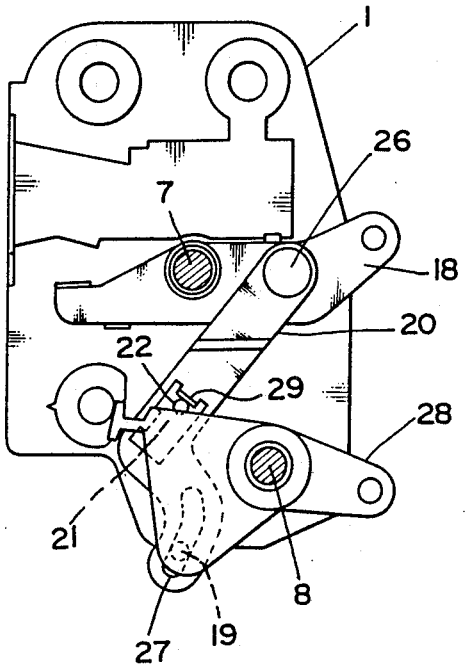
FIG. 7 is a rear elevation of the lock device.

Referring to FIG. 7 which shows a back side of the lock device under the door closed and unlocked condition, an open lever 18 to be connected to a door handle (not shown) is rotatably mounted on the shaft 7, and a connecting lever 20 is rotatably supported at its upper end through a pin 26 to the open lever 18. The connecting lever 20 is formed with an opening 21 having an inward projection 29 which engages a pin 22 projecting from the ratchet 3. Accordingly, when the open lever 18 is rotated clockwise, the connecting lever 20 is lowered with the result that the pin 22 is urged downwardly by the projection 29 to thereby rotate the ratchet 3 to be released from the latch 2.

The connecting lever 20 is formed at its lower portion with an elongated hole 27 engaging a pin 19 projecting from a lock lever 28 rotatably mounted on the shaft 8. Accordingly, when the lock lever 28 is rotated clockwise, the connecting lever 20 is rotated counterclockwise about the pin 26 to release the pin 22 from the projection 29. As a result, the ratchet 3 is locked, and even when the open lever 18 is rotated, the ratchet 3 cannot be rotated.

Referring next to FIGS. 10 to 13 which show a second preferred embodiment of the present invention wherein the same parts as in the first preferred embodiment are designated by the same reference numerals, it is featured that a large compression spring 30 is provided instead of the torsion spring 16 in the first preferred embodiment.

The spring recess 31 formed in the lock body 1 is partitioned into a first recess 31A for accommodating the small compression spring 12 and a second recess 31B for accommodating the large compression spring 30. The first recess 31A is narrower than the second recess 31B, and a shoulder 35 is formed between the first recess 31A and the second recess 31B. The small compression spring 12 has an elastic modulus equal to that of the prior art lock device, and the large compression spring 30 has an elastic modulus larger than that of the spring 12.

Reference numeral 32 designates a spring support having a head portion 33 of a larger diameter than the shoulder 35 and a leg portion 34 extending from the center of the head portion 33. The head portion 33 is interposed between the shoulder 35 and the large compression spring 30, and the leg portion 34 is inserted into the small compression spring 12 to extend toward the ratchet 3.

Figure 12:
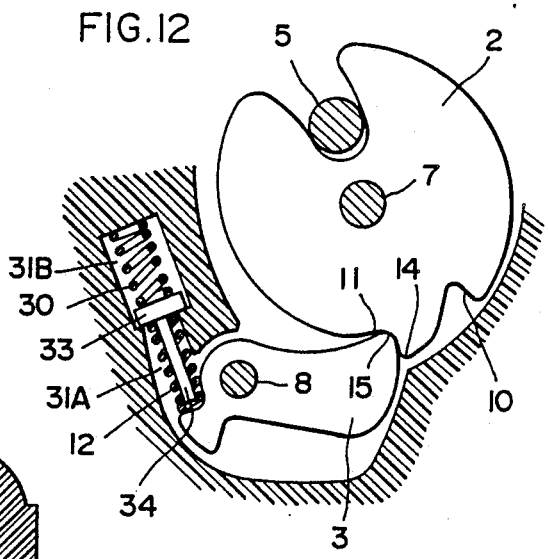
FIG. 12 is an elevational view of the essential part of the lock device under the full-latch condition.
Figure 11:
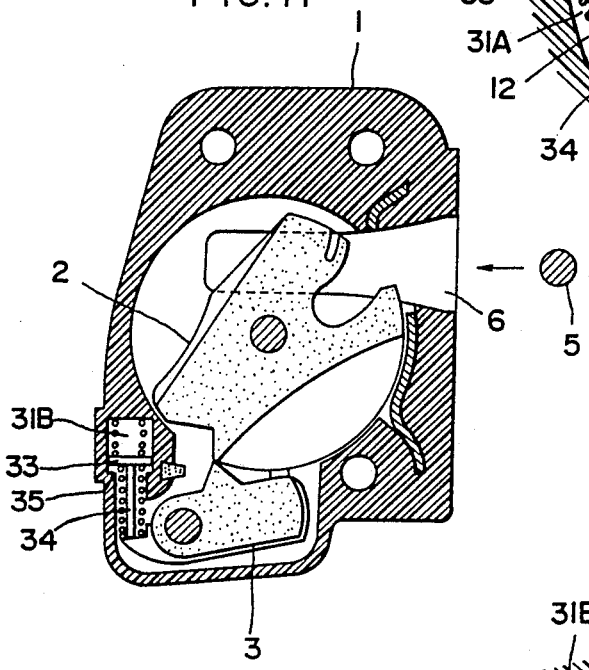
FIG. 11 is an elevational view of the lock device in the second preferred embodiment under the door open condition.

The leg portion 34 has a length such that it does not reach the ratchet under the full-latch condition as shown in FIG. 12, while when the door is opened to dispose the corner 15 of the ratchet 3 to the position facing to the arcuate corner 14 of the latch 2, the leg portion 34 reaches the ratchet 3. Accordingly, under the full-latch condition, the head portion 33 of the spring support 32 is biased by the large elastic force of the large compression spring 30 against the shoulder 35, and the ratchet 3 is urged only by the elastic force of the small compression spring 12.

Referring to FIGS. 14 to 18 which show a third preferred embodiment of the present invention, wherein the same parts as in the first preferred embodiment are designated by the same reference numerals, it is featured that a hook type tension spring 36 is provided instead of the torsion spring 16 in the first preferred embodiment.

The tension spring 36 is formed at its opposite ends with hook portions 39 and 40, and the latch 2 and the ratchet 3 are formed with projections 37 and 38, respectively, The hook portion 39 is relatively largely formed so as to loosely engage the projection 37, while the hook portion 40 is tightly engaged with the projection 38.

Figure 16:
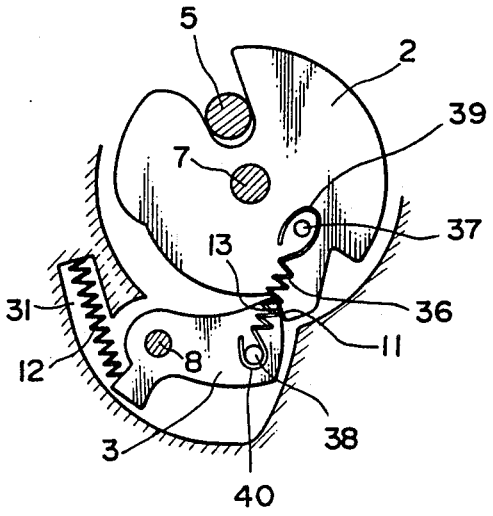
FIG. 16 is an elevational view of the essential part of the lock device under the full-latch condition.

Under the full-latch condition as shown in FIG. 16, the length of the tension spring 36 is greater than the distance between both the projections 37 and 38. In other words, the hook portion 39 is hooked to the projection 37 with a play, but no elastic force of the tension spring 36 is applied to the projection 37. In opening the door, when the corner 15 of the ratchet 3 comes to a position facing to the arcuate corner 14 of the latch 2, the length of the tension spring 36 becomes substantially equal to the distance between both the projections 37 and 38. In other words, the hook portion 39 comes to close engagement with the projection 37 by the elastic force of the tension spring 36 to maintain the contact between the ratchet 3 and the latch 2.

Figure 18:
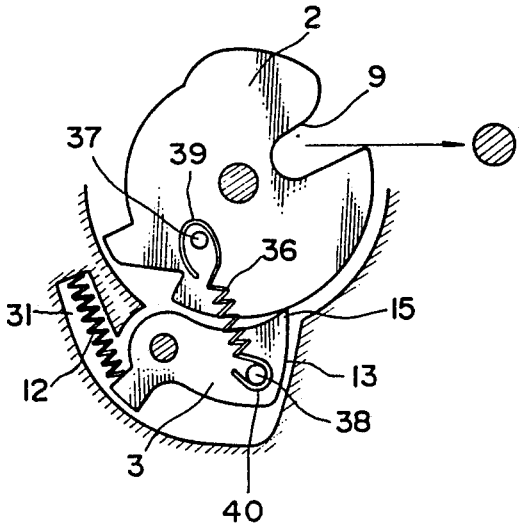
FIG. 18 is a view similar to FIG. 16, showing the door open condition.

Under the door open condition as shown in FIG. 18, the length of the tension spring 36 is greater than the distance between both the projections 37 and 38.

OPERATION

Figure 3:
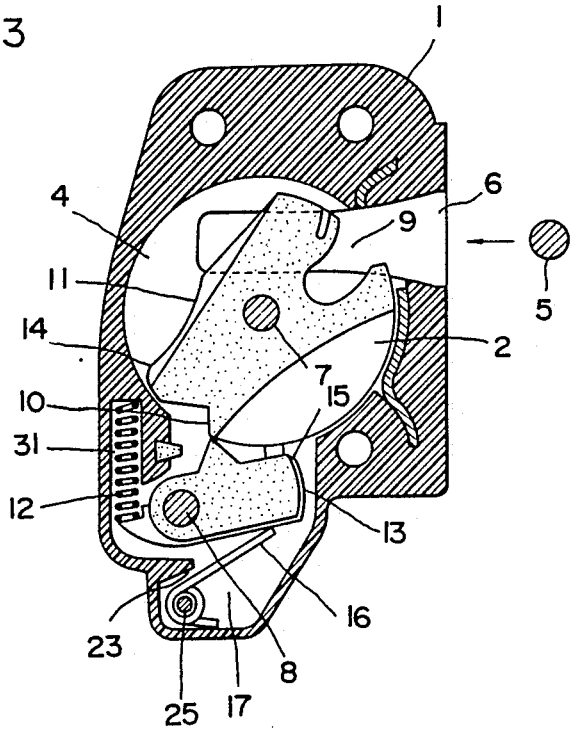
FIG. 3 is a vertical sectional view of the lock device in the first preferred embodiment under the door open condition.
Figure 2:
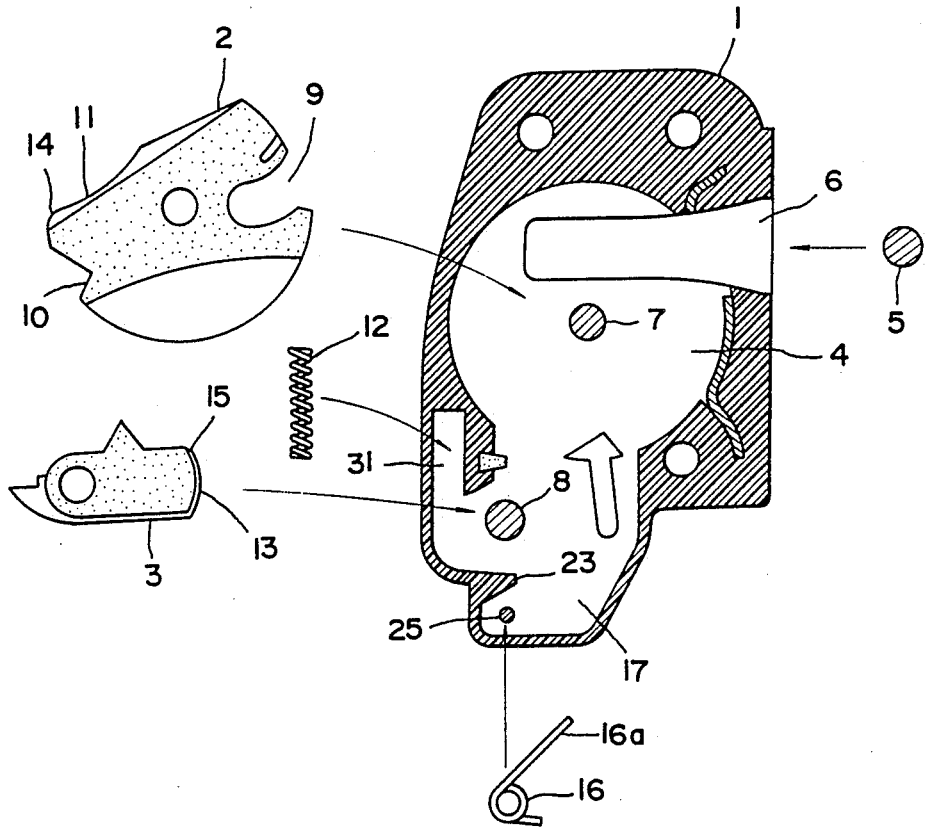
FIG. 2 is an exploded view of the lock device in a first preferred embodiment of the present invention.

First, the operation of the first preferred embodiment will be described. Under the door open condition as shown in FIG. 3, the ratchet 3 is in strong contact with the outer peripheral surface of the latch 2 by the elastic forces of the compression spring 12 and the torsion spring 16. When the door is closed from the above condition, the groove 9 of the latch 2 is brought into engagement with the striker 5 fixed to the vehicle body, thereby rotating the latch 2 counterclockwise as shown in FIG. 4. As a result, the engagement surface 13 of the ratchet 3 passes over the half-latch stepped portion 10 to come into engagement with the full-latch stepped portion 11, thus completely closing the door. Under the door closed condition, the ratchet 3 is maintained in engagement with the latch 2 only by the elastic force of the compression spring 12.

In opening the door from the closed condition by rotating the open lever 18, the engagement surface 13 of the ratchet 3 is gradually released from the full-latch stepped portion 11, and comes to a position where the corner 15 of the ratchet 3 faces the arcuate corner 14 of the latch 2 as shown in FIG. 9. Under the condition, the door tends to be opened by a considerably strong force due to a reaction of a damping and sealing rubber interposed between the door and the vehicle body. As a result, the latch 2 tends to be rotated clockwise as viewed in FIG. 9. That is, the ratchet 3 is urged by the arcuate corner 14 of the latch 2 and is rotated at a speed greater than that of the door opening operation.

Such a speed upon rotation of the ratchet 3 against the elastic force of the compression spring 12 is high enough to separate the corner 15 of the ratchet 3 from the arcuate corner 14 of the latch 2. Accordingly, if the torsion spring 16 is not provided, the corner 15 will be separated from the arcuate corner 14 of the latch 2, and will then be returned to abut against the outer peripheral surface of the latch 2 by the elastic force of the compression spring 12. At this time, there will be generated a considerably large impact noise.

To eliminate the generation of such an impact noise, the preferred embodiment employs the torsion spring 16. That is, under the full-latch condition as shown in FIG. 4, the leg portion 16*a* of the torsion spring 16 is engaged with the stopper 23 to apply no elastic force to the ratchet 3. However, when the open lever 18 is rotated in opening the door to dispose the corner 15 of the ratchet 3 to a position facing to the arcuate corner 14 of the latch 2, the ratchet 3 is brought into elastic engagement with the leg portion 16*a* of the torsion spring 16 as shown in FIG. 9. Accordingly, it is possible to prevent the separation of the corner 15 from the arcuate corner 14 by the elastic force of the torsion spring 16, thereby eliminating the generation of the impact noise. Moreover, since the elastic modulus of the torsion spring 16 is hardly affected by the temperature environment, the noise prevention effect can be maintained constant.

Next, the operation of the second preferred embodiment will be described. Under the full-latch condition as shown in FIG. 12, the head portion 33 of the spring support 32 is biased by the large compression spring 30 against the shoulder 35, but the leg portion 34 of the spring support 32 does not reach the ratchet 3. Accordingly, the ratchet 3 is biased only by the small compression spring 12 to maintain the full-latch condition.

Figure 13:
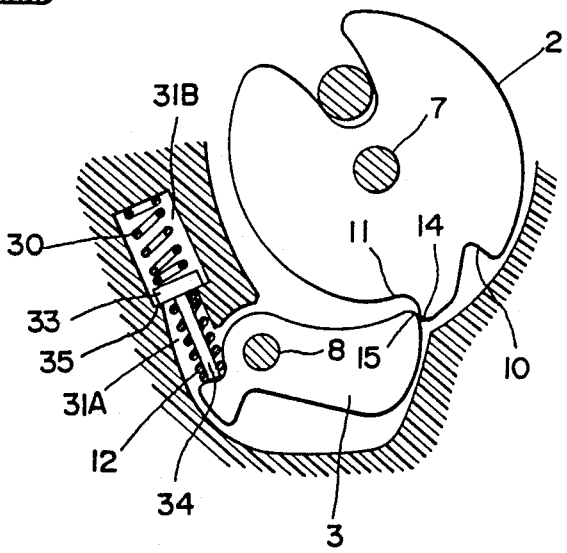
FIG. 13 is a view similar to FIG. 12, showing the condition where the ratchet and the latch face each other at their corners.
Figure 14:
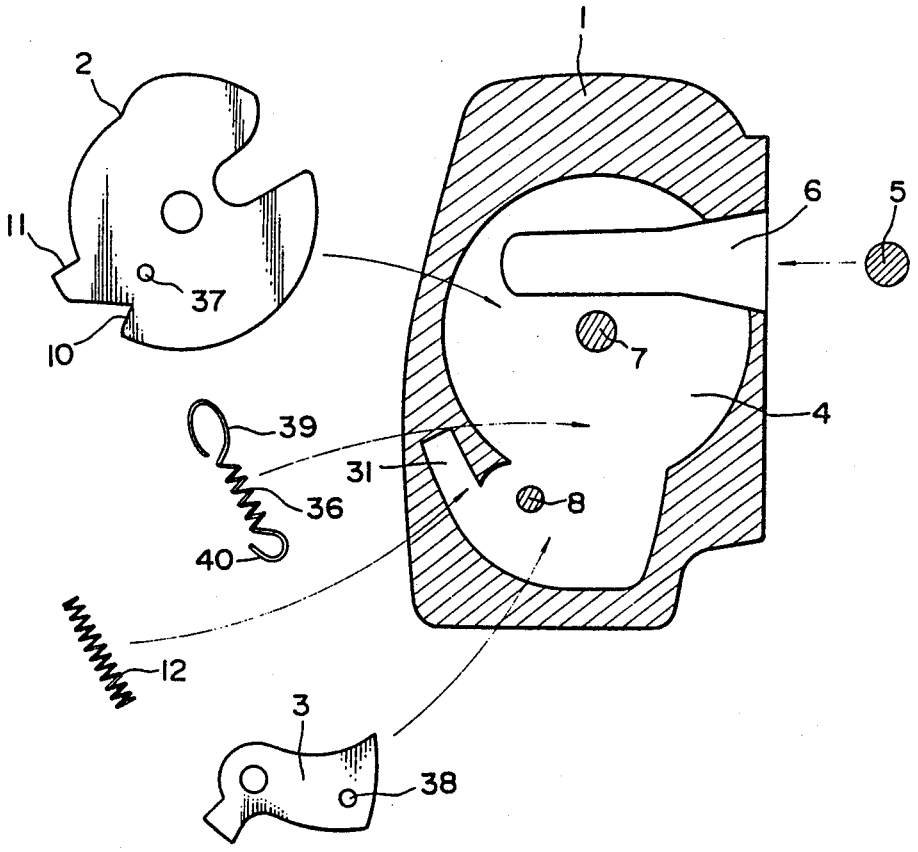
FIG. 14 is an exploded view of the lock device in a third preferred embodiment of the present invention.
Figure 15:
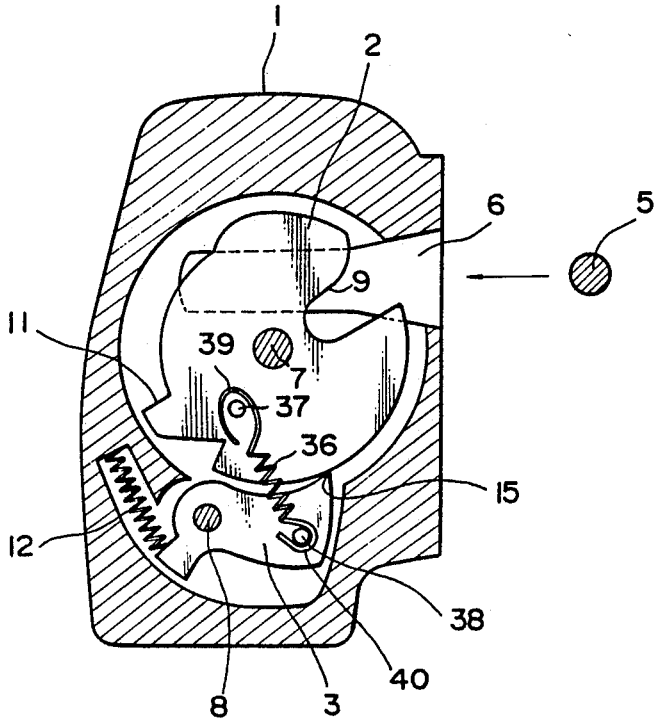
FIG. 15 is an elevational view of the lock device in the third preferred embodiment under the door open condition.

When the ratchet 3 is rotated against the elastic force of the small compression spring 12 by opening the door, the corner 15 of the ratchet 3 comes to a position facing to the arcuate corner 14 of the latch 2 as shown in FIG. 13. In this condition, the small compression spring 12 is compressed to make the leg portion 34 of the spring support 32 to contact the ratchet 3. Although the ratchet 3 tends to be rotated by the reaction of the damping and sealing rubber as mentioned previously, the ratchet 3 is strongly biased by the large compression spring 30 through the spring support 32 to thereby prevent the separation of the corner 15 from the arcuate corner 14 of the latch 2. Thus, the generation of the impact noise can be prevented. Moreover, since the elastic modulus of the large compression spring 30 is hardly affected by the temperature environment, the noise prevention effect can be maintained constant.

Finally, the operation of the third preferred embodiment will be described. Under the full-latch condition as shown in FIG. 16, as the length of the tension spring 36 is greater than the distance between both the projections 37 and 38, the elastic force of the tension spring 36 is not applied to the ratchet 3. Accordingly, the ratchet 3 is biased only by the elastic force of the compression spring 12 to maintain the full-latch condition.

Figure 17:
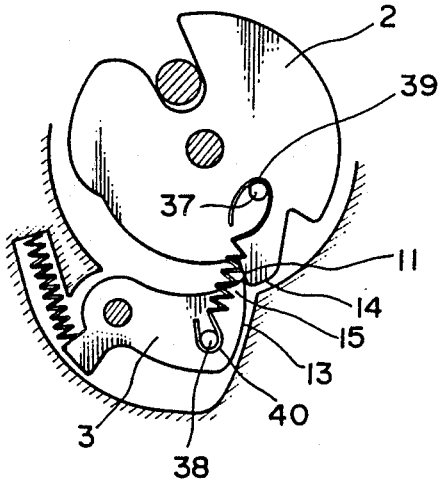
FIG. 17 is a view similar to FIG. 16, showing the condition where the ratchet and the latch face each other at their corners.

When the ratchet 3 is rotated against the elastic force of the compression spring 12 by opening the door, the corner 15 of the ratchet 3 comes to a position facing to the arcuate corner 14 of the latch 2 as shown in FIG. 17. In this condition, the hook portion 39 of the tension spring 36 is closely engaged with the projection 37. That is, the length of the tension spring 36 is substantially equal to the distance between both the projections 37 and 38. Accordingly, even when the ratchet 3 tends to be further rotated, the separation of the corner 15 from the arcuate corner 14 of the latch 2 is prevented by the elastic force of the tension spring 36, thereby eliminating the generation of the impact noise. Moreover, since the elastic modulus of the tension spring 36 is hardly affected by the temperature environment, the noise prevention effect can be maintained constant.

What is claimed is:

1. A noise suppressing device in a lock device for a vehicle, comprising:
   - a body to be fixed to a door of said vehicle;
   - a latch rotatably supported in said body and adapted to be rotated by engagement with a striker fixed to a vehicle body;
   - a ratchet rotatably supported in said body and adapted to engage a full-latch stepped portion of said latch and thereby prevent reverse rotation of said latch;
   - first and second spring members for biasing said ratchet to engage the same with said latch wherein said second spring member comprises a helical torsion spring; and
   - an open lever for releasing engagement of said ratchet with said full-latch stepped portion;
   - wherein said first spring member normally biases said ratchet to engage the same with said latch, and said second spring member does not bias said ratchet under a full-latch condition where said ratchet is engaged with said full-latch stepped portion of said latch, while when said ratchet is rotated in a releasing direction said second spring member biases said ratchet.

2. A noise suppressing device in a lock device for a vehicle, comprising:
   - a body to be fixed to a door of said vehicle;
   - a latch rotatably supported in said body and adapted to be rotated by engagement with a striker fixed to a vehicle body;
   - a ratchet rotatably supported in said body and adapted to engage a full-latch stepped portion of said latch and thereby prevent reverse rotation of said latch;
   - first and second spring members for biasing said ratchet to engage the same with said latch; and
   - an open lever for releasing engagement of said ratchet with said full-latch stepped portion;
   - wherein said first spring member normally biases said ratchet to engage the same with said latch, and said second spring member does not bias said ratchet under a full-latch condition where said ratchet is engaged with said full-latch stepped portion of said latch, while when said ratchet is rotated in a releasing direction said second spring member biases said ratchet, wherein an elastic force of said second spring member to be applied to said ratchet is increased as said ratchet is rotated in the releasing direction.

3. A noise suppressing device in a lock device for a vehicle, comprising:

a body to be fixed to a door of said vehicle;

a latch rotatably supported in said body and adapted to be rotated by engagement with a striker fixed to a vehicle body;

a ratchet rotatably supported in said body and adapted to engage a full-latch stepped portion of said latch and thereby prevent reverse rotation of said latch;

first and second spring members for biasing said ratchet to engage the same with said latch; and an open lever for releasing engagement of said ratchet with said full-latch stepped portion;

wherein said first spring member normally biases said ratchet to engage the same with said latch, and said second spring member does not bias said ratchet under a full-latch condition where said ratchet is engaged with said full-latch stepped portion of said latch, while when said ratchet is rotated in a releasing direction said second spring member biases said ratchet, wherein an elastic force of said second spring member to be applied to said ratchet is decreased as said ratchet is rotated in the releasing direction.

4. A noise suppressing device in a lock device for a vehicle, comprising:

a body to be fixed to a door of said vehicle;

a latch rotatably supported in said body and adapted to be rotated by engagement with a striker fixed to a vehicle body;

a ratchet rotatably supported in said body and adapted to engage a full-latch stepped portion of said latch and thereby prevent reverse rotation of said latch;

an open lever for releasing engagement of said ratchet with said full-latch stepped portion;

a first recess formed in said body;

a second recess substantially straight communicated with said first recess;

a shoulder formed between said first recess and said second recess;

a spring support having a head portion accommodated in said second recess and adapted to engage said shoulder and a leg portion extending from a center of said head portion through said first recess toward said ratchet;

a first spring member accommodated in said first recess and interposed between said head portion and said ratchet; and a second spring member accommodated in said second recess and adapted to bias said head portion against said shoulder, said second spring member having an elastic modulus larger than that of said first spring member;

wherein said head portion of said spring support abuts against said shoulder by an elastic force of said second spring member but said leg portion of said spring support does not contact said ratchet under a full-latch condition where said ratchet is engaged with said full-latch stepped portion of said latch, while when said ratchet is rotated in a releasing direction against an elastic force of said first spring member, said ratchet is brought into abutment against said leg portion.

5. A noise suppressing device in a lock device for a vehicle, comprising:

a body to be fixed to a door of said vehicle;

a latch rotatably supported in said body and adapted to be rotated by engagement with a striker fixed to a vehicle body, said latch having a first projection on an outer surface thereof;

a ratchet rotatably supported in said body and adapted to engage a full-latch stepped portion of said latch and thereby prevent reverse rotation of said latch, said ratchet having a second projection on an outer surface thereof;

a first spring member for normally biasing said ratchet to engage the same with said latch; and a second spring member connected between said first projection of said latch and said second projection of said ratchet and adapted to bias said ratchet so as to engage the same with said latch;

wherein the relationship between said second spring member and said first and second projections is such that;

(A) a length of said second spring member is larger than a distance between said first and second projections under a full-latch condition where said ratchet is engaged with said full-latch stepped portion of said latch, so that an elastic force of said second spring member may not be applied to said ratchet; and (B) when said ratchet is rotated in a releasing direction against an elastic force of said first spring member, the length of said second spring member becomes equal to the distance between said first and second projections, so that the elastic force of said second spring member may start being applied to said ratchet.

6. The noise suppressing device as defined in claim 5, wherein when said door is in an open condition, the length of said second spring member is larger than the distance between said first and second projections so that the elastic force of said second spring member may not be applied to said ratchet.

* * * * *